US005452687A

United States Patent [19]

Christiansen

[11] Patent Number: 5,452,687

[45] Date of Patent: Sep. 26, 1995

[54] MICROPROCESSOR-BASED BOILER SEQUENCER

[75] Inventor: Leo P. Christiansen, Mendota Heights, Minn.

[73] Assignee: Century Controls, Inc., Edina, Minn.

[21] Appl. No.: 247,237

[22] Filed: May 23, 1994

[51] Int. Cl.[6] ..... F22B 37/42

[52] U.S. Cl. ..... 122/448.3; 236/78 D; 431/60

[58] Field of Search ..... 236/78 D, 15 BD; 122/446, 448.3; 431/60

[56] References Cited

U.S. PATENT DOCUMENTS

| | | | |
|---|---|---|---|
| 4,513,910 | 4/1985 | Bartels | 236/26 R |
| 4,787,554 | 11/1988 | Bartels et al. | 236/78 D X |
| 4,994,959 | 2/1991 | Ovenden et al. | 236/158 BD X |
| 5,042,431 | 8/1991 | Shprecher et al. | 122/448.3 |
| 5,172,654 | 12/1992 | Christiansen | 122/448.3 |
| 5,355,938 | 10/1994 | Hosoya et al. | 236/78 D X |

OTHER PUBLICATIONS

Fireye Bulletin, E-3401(A), Oct. 1991, E340 Boiler Room Control Technical Description and Set-Up Manual.

*Primary Examiner*—William E. Wayner
*Attorney, Agent, or Firm*—Haugen and Nikolai

[57] ABSTRACT

A boiler sequencer system having a microprocessor based controller which allows the firing rate for multiple boilers to be increased or decreased with a proportional output integrated with the process variable rate of recovery that is desired, preventing unnecessary rapid advancements to high fire even when a boiler is started with a high off-set of the process variable from its set point. The controller automatically overrides this proportionate control when the process variable rises above a predetermined maximum or falls below a predetermined minimum.

9 Claims, 4 Drawing Sheets

* PΣ = RUNNING TIME IN SECONDS FROM END OF PRECEEDING MINIMUM RESPONSE.

MICROPROCESSOR-BASED BOILER SEQUENCER

BACKGROUND OF THE INVENTION

1. Field of the Invention

This invention relates generally to automatic controls for boilers, and more particularly to a microprocessor-based sequencer and method for operating the same, capable of monitoring changes in load demand and adjusting the firing rate in proportion to the rate at which the boiler is called upon to satisfy the load demand and staying at the preferred process variable (PV) set-point.

2. Discussion of the Prior Art

Various systems are disclosed in the prior art that modulate the firing rate of multiple boilers in a coordinated fashion, so that they jointly meet the load demands of a heating system or other industrial process. Several examples that require modulation of the firing rate of multiple boilers include: a heating system that requires steam to maintain the temperature in a building, kitchen steam absorption chillers, industrial processors, or any other consumer of steam or hot water that demands steam or hot water at a preferred level, e.g. retorts and cookers. There is a need to control the firing rates of multiple boilers to efficiently meet the load (output) demands. For example, the Bartels U.S. Pat. No. 4,513,910, operating under hysteresis, discloses a boiler operating system in which the boiler firing rate is a function of the boiler pressure, whereby the boiler operating system provides for the adjustment of the fire rate as the load demand on the boiler increases or decreases the boiler pressure. The control mechanism described in the patent automatically switches to a normal high fire and modulating mode if the boiler demand cannot be met at the low fire operating point.

The Shprecher et al. U.S. Pat. No. 5,042,431 describes a microprocessor based sequencer for a multiple boiler heating system. Each boiler or stage in a multiple boiler system is provided with an adjustable firing level of modulation at which the boiler is turned on, and an adjustable threshold level of modulation (the Mod. Pt.), below which the next stage is disabled from being turned on. A control device for the system continuously compares temperature in the medium being heated to a set-point temperature for the system and determines the total change in the output level which would be required to produce a specified temperature within a predetermined time. The microprocessor then adjusts the firing rate to meet this demand. This demand is spread equally among successive stages.

The Christiansen U.S. Pat. No. 5,172,654, assigned to applicant's assignee, describes a microprocessor-based boiler controller that base loads individual boilers at their most efficient firing rate. For example, in a base load mode of operating three boilers, on original start-up, the first boiler carries the load until its firing rate reaches its programmable "Add boiler load set-point" (which may be, for example, about 45 percent). At this time, the second boiler fires and is held at "low fire" for a fixed time sufficient to alleviate some damage due to thermal shock. The second boiler then follows the load in parallel with the first boiler until the second boiler reaches an "Effect Base Load set-point", at for example 25 percent.

Whenever possible, one or more boilers are allowed to operate at their preferred load at which their efficiency in combination is a maximum. Additional boilers are added to the system in like manner as the output demand increases. The boilers' firing rates are increased or decreased by a fixed percentage. By providing an automated base load feature, considerable fuel savings over the parallel mode of boiler operation can be realized. Further, by allowing intermittent warm up of the idle boilers, less repair and down time are experienced.

As those skilled in the art can appreciate, a certain amount of repairs and downtime from thermal shock is attributable to increasing the firing rate from low fire to high fire at a fixed rate or at a rate proportional to time. Also, the firing rate in these systems may overshoot the desired set-point or start up when the demand is low, thereby wasting fuel. Further, another frequent problem occurs when there is a large offset between the process variable (output) and the desired set-point (desired output). The prior art controls often increase the firing rate more than is required, and may even unnecessarily increase the firing rate on multiple boilers, thereby wasting fuel, and causing thermal shock to the tubes and refractory. Also, when more than one boiler is simultaneously increased to high fire, there is a rapid flux in the demand for water, often resulting in the water control sensors needlessly instituting a failure of the water level, and causing an unnecessary shutdown of the boiler.

Therefore, to further reduce the amount of wasted fuel, and the deleterious effects of thermal (repairs, downtime and premature wear on the boiler tubes), a control over the firing rate of the boilers as a function of the rate of change in output is needed in addition to normal proportional response. These and other disadvantages of the prior art are overcome by controlling the firing rate with proportional control of the firing rate but integrating the recovery rate into the control algorithm independently on each side of the PV set-point, thereby allowing the system to respond more slowly on one side of the set-point than on the other. By controlling the firing rate in this manner, the need for a second boiler, in some circumstances, may be eliminated. Further, the need for two boilers to run at high fire for several minutes may be avoided, which also decreases the amount of fuel spent. More importantly, thermal shock is prevented by increasing the firing rate, taking into account the rate of recovery of the process variable, rather than moving to high fire whenever the process variable falls below the set-point by a given offset.

SUMMARY OF THE INVENTION

In accordance with the present invention, a boiler sequencer computerized control system is provided which comprises a plurality of boilers, each having means for varying the firing rate thereof, a means for sensing the existing firing rate, a means for sensing the temperature or pressure output from the boiler, and a means for providing sense signals proportional thereto. Within the control system is a microprocessor based controller having memory means for storing, with respect to time, a plurality of programmable parameter values for each of the plurality of boilers, including a Process Variable set-point, a preferred set-point for the output level, a deadband constant, a process variable minimum response time, a process variable minimum response required, a boiler response interval, an initial boiler firing rate, a decrease return factor, a decrease span range, a maximum increase/decrease in firing rate, a maximum process variable value, a threshold minimum process variable value, a forced low firing rate value, a forced high firing rate value, an increase return value, an increase span range, a decrease leaving value, an increase leaving value, and an adjustable nudge factor. Also included is a means for entering the plurality of parameter values into the memory means, whereby the microprocessor-based controller produces a plurality of control signals, each directed to the means for varying the firing rate of the plurality of boilers. Also, as part of the microprocessor-based controller is a means for determining whether the process variable from the boilers is higher or lower than the preferred set-point. The controller also has a means for determining whether the output is approaching or leaving the preferred set-point, and if so, adjusts the firing rate in proportion to the rate at which the output is returning toward or leaving the preferred set-point. The controller also automatically overrides this gradual increase or decrease in the firing rate when the process variable exceeds the maximum process variable value or is less than the threshold minimum process variable value.

Thus, the sequencer of the present invention strives to maintain the process variable at the preferred set-point by controlling the firing rate of each boiler without over compensating or approaching the preferred set-point more rapidly than necessary. This is accomplished by the ability to respond at a different rate on each side of the set-point with an override by the "nudge factor." In this manner, the amount of downtime for repairs, and premature wear from thermal shock are further reduced.

DESCRIPTION OF THE DRAWINGS

The foregoing features and advantages of the present invention will be readily apparent to those skilled in the art from a review of the following detailed descriptions of the preferred embodiment in conjunction with the accompanying drawings in which.

DETAILED DESCRIPTION OF THE PREFERRED EMBODIMENT

Figure 1:
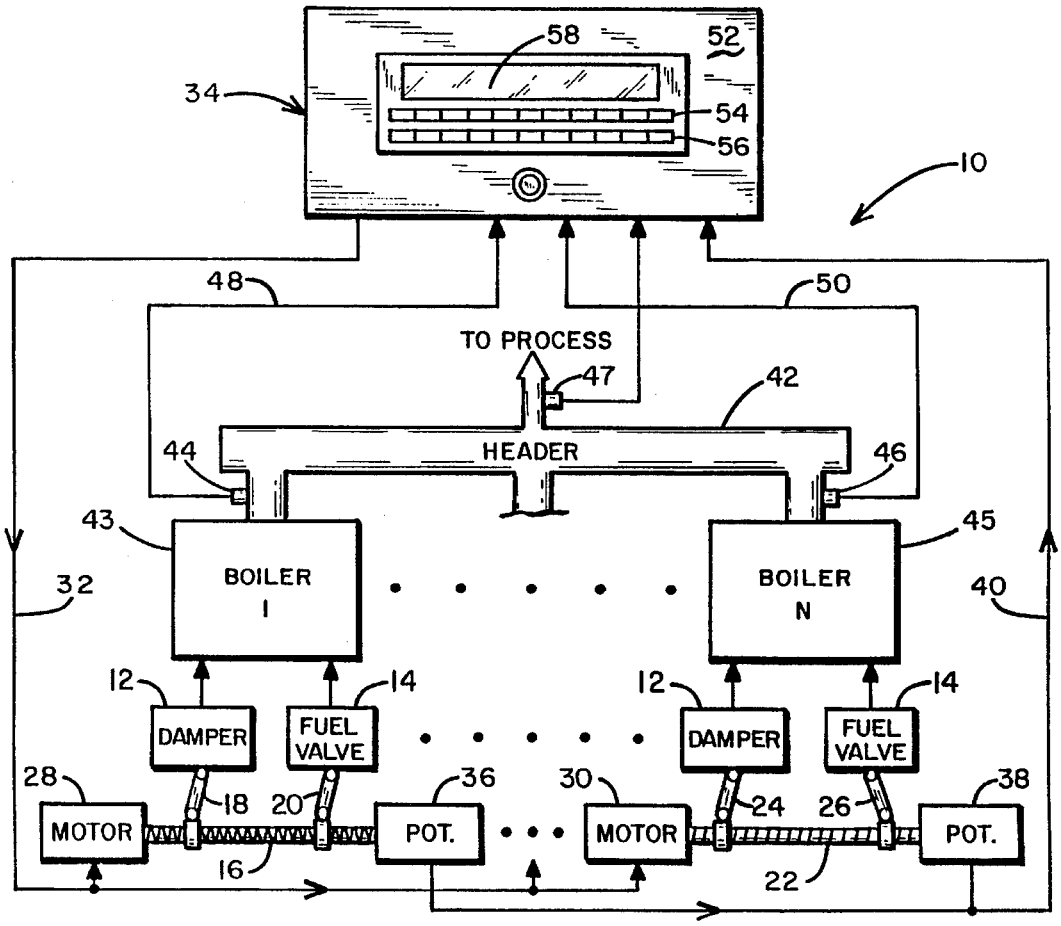
FIG. 1 is a block diagram of a multiple boiler system incorporating the microprocessor-based sequencer of the present invention.

Referring first to FIG. 1, there is indicated generally by numeral 10 a multiple boiler system incorporating a preferred embodiment of the sequence controller of the present invention. The system is seen to include a plurality of boilers including boiler one 43 through boiler N 45, and each has associated with it a damper 12, a fuel valve 14, a motor 28, 30, potentiometers 36 and 38, header 42, a temperature or pressure sensor 44, 46, a sensor for process variable output 47, and a sequencer 34.

Figure 2:
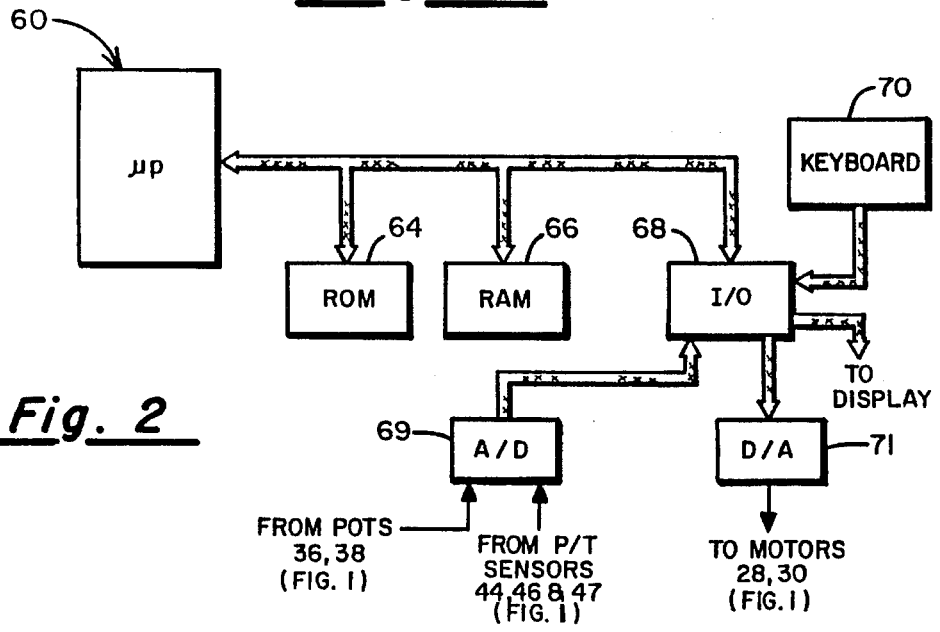
FIG. 2 is a logical block diagram of the sequencer portion of the system shown in FIG. 1.

Referring next to FIG. 2 the heart of the sequencer 34 is a microprocessor 60 which may be a TI 9995 available through Texas Instruments Company of Dallas, Tex. The necessary details of the multiple boiler system are incorporated herein by reference from the aforereferenced Christiansen U.S. Pat. No. 5,172,654. The main distinction between the invention described in the '654 patent and the present invention is that in accordance with the present invention, the firing rate is adjusted in proportion to the rate at which the output is returning or leaving the preferred set-point.

At the time of installation of the sequencer of the present invention, various parameters are entered into the RAM memory 66 (FIG. 2), based upon experience or knowledge of the boiler system performance under manual control.

Figure 3:
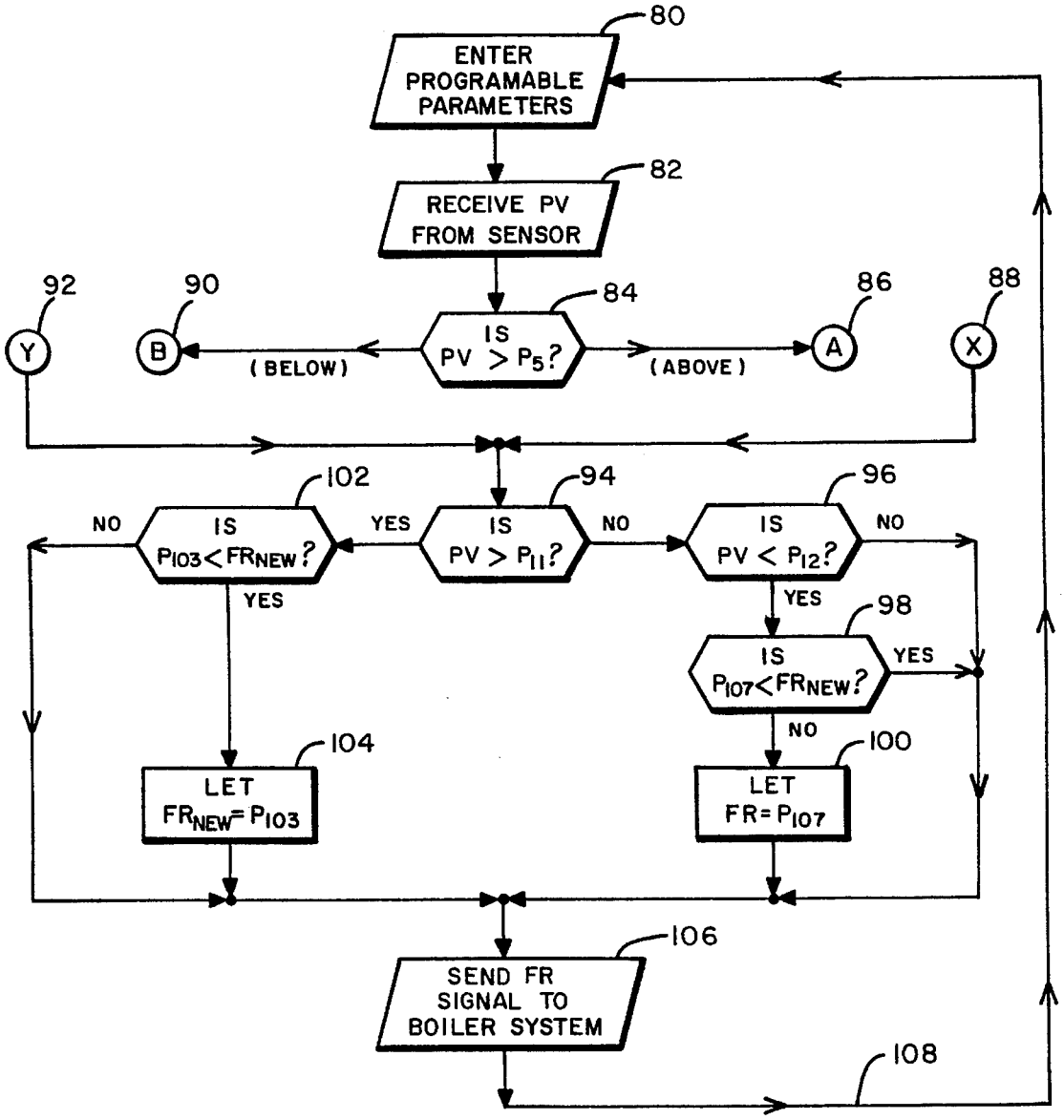
FIG. 3, 3A, and 3B together comprise a flow diagram of the software used to run the firing rate controller of the sequencer.

Prior to start up, the sequencer provides for two modes, namely the cold standby mode, and the warm standby thermal shock protection mode. At startup, the various parameters are set at default settings. More particularly, the following parameters labeled $P_N$ for identification in the flow charts of FIGS. 3–3B are involved in the algorithm incorporated in the microprocessor-based sequencer that further protects the boiler's tubes from thermal shock: the Process Variable (PV), the current Process Variable value ($PV_{NEW}$), the previous Process Variable value ($PV_{OLD}$), the preferred set-point for the output level ($P_5$), the adjusted set-point for the output level ($P'_5$), the running time from the end of the preceding minimum response ($P_\Sigma$), the deadband constant ($P_{13}$), the process variable minimum response time ($P_{99}$), the process variable minimum response required ($P_{95}$), the boiler response interval ($P_{91}$), the firing rate (FR), the adjusted firing rate ($FR_{NEW}$), the current firing rate ($FR_{OLD}$), the decrease return factor ($P_{79}$), the decrease span range ($P_{87}$), the maximum increase/decrease factor ($P_{111}$), the maximum process variable value ($P_{11}$), the threshold minimum process variable value ($P_{12}$), a forced low firing rate value ($P_{103}$), a forced high firing rate value ($P_{107}$), an increase return factor ($P_{71}$), an increase span range ($P_{83}$), the decrease leaving factor ($P_{75}$), the increase leaving factor ($P_{67}$), and an adjustable nudge factor ($P_{115}$). The microprocessor based controller of the present invention has the capability to differentiate between a PV offset from the set-point associated with a true demand for accelerating the firing rate and an ordinary offset due to a mere change in the set-point or upon turning on of a boiler and can accomodate both.

Figure 3A:
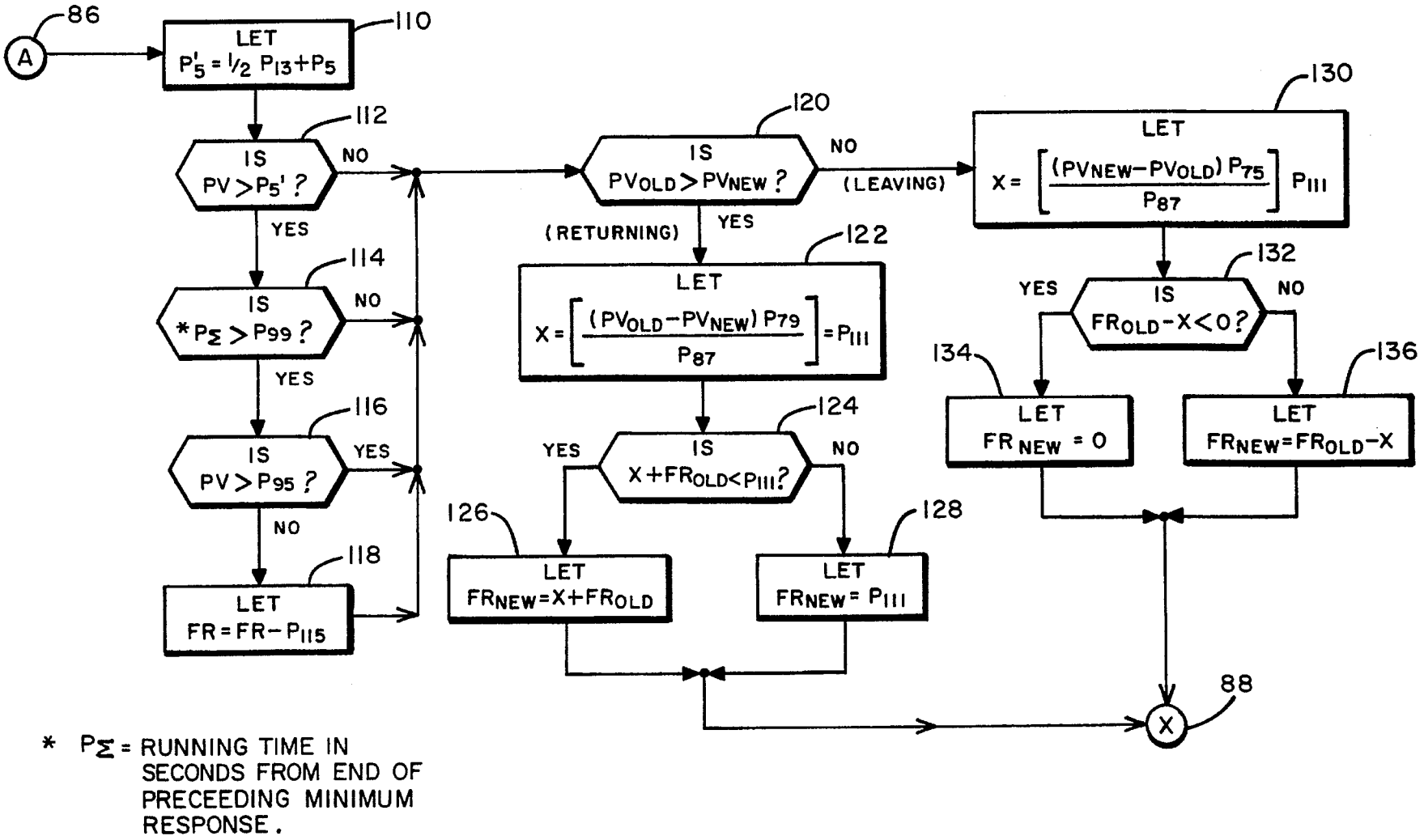
Figure 3B:
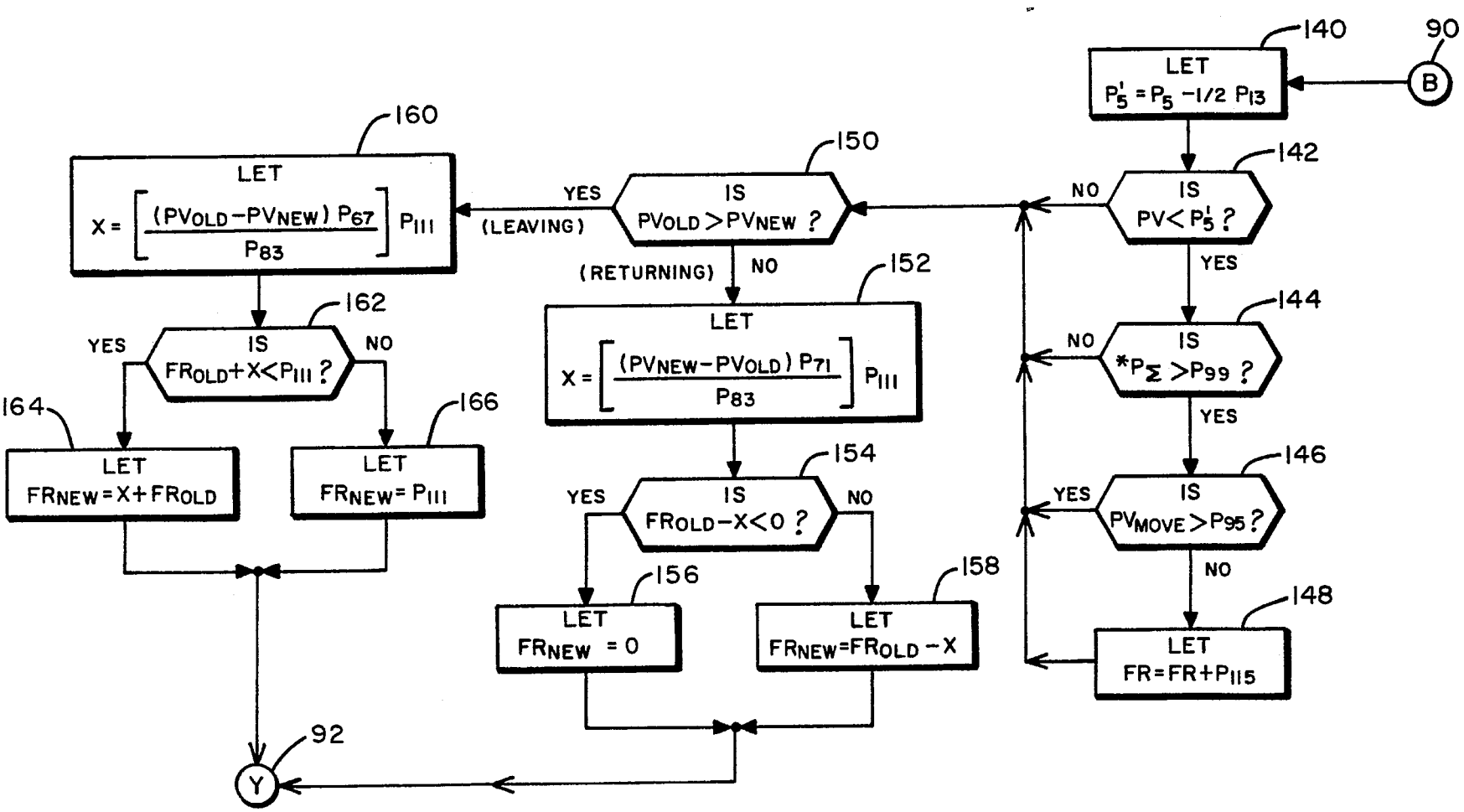

With reference now to FIGS. 3, 3A, and 3B, an explanation will be given of the algorithm incorporated in the microprocessor based sequencer. The PV may fluctuate either above or below the preferred set-point. The algorithm controls the firing rate of multiple boilers with proportional output, integrating the process variable's rate of recovery toward the process variable set point as it applies to each side of the process variable set-point. Those skilled in programming a typical microprocessor, such as the TI 9995, are in a position to write the detailed code from what is presented in the flow diagram of FIGS. 3, 3A, 3B and from the following explanation of a given herein.

On initial startup, the parameters are set at default values. The operator may change these default settings by changing the programmable parameters using the data entry keys 54 and 56 on the sequencer 34. The sequencer then receives an analog signal from the process variable sensor 47 which is converted to a digital quantity by an A/D converter 69. If the process variable is above the preferred set-point, the sequencer then determines whether the process variable is leaving from or returning to the preferred set-point. If the process variable is returning, the firing rate is increased in proportion to the rate of change in the process variable. If the process variable is leaving from the preferred set-point, the firing rate is reduced in proportion to the rate of change in the process variable. If the process variable is below the preferred set-point, it is determined whether the process variable is leaving from or returning to the preferred set-point. If the process variable is returning to the preferred set-point, the firing rate is reduced slowing down the rate of change in output. If, however, the process variable is below and leaving the preferred set-point, the firing rate is increased in proportion to the rate of change in output.

When a boiler comes on line with a large offset between the process variable and the set-point or when the low set point process variable is increased according to a schedule, the microprocessor uses the adjustable minimum response in adjustable seconds to determine action, or "nudge" to bring the process variable to set-point. In many cases, the offset between the process variable and set point is not caused by a large change in demand. Instead, the offset is often caused by starting a first boiler in a sequence during light load demands, or according to a scheduled increase in the set-point. In these cases, the starting point for the first boiler can be adjusted to start at a 20–30% firing rate, and then proceed from there nudging the system slowly upward as long as the recovery does not meet the adjustable process variable rate of recovery within the time limitations.

The sequencer next checks to see whether the process variable has fallen below the threshold minimum output value or has risen above the maximum output value. If the process variable has fallen below the threshold minimum output value, there is a forced increase to a higher firing rate in accordance with the value that is set (e.g., forced to 50 percent, 75 percent, etc.) and resumes normal control from there. If the process variable has risen above the maximum output value, a forced decrease to low fire value is set. The sequencer then sends an output signal to the boiler, adjusting its firing rate. If the process variable is recovering too fast, the the sequencer automatically adjusts the firing rate to avoid overshooting the set-point. Using the same process variable, the sequencer determines the firing rates in proportion to rate of change in output over time for all other active boilers. The sequencer then receives another input signal from the process variable sensor and then repeats the above steps readjusting the firing rate, if necessary.

Having generally explained control of the firing rate in proportion to the rate of change in output over time, the flow diagram of FIGS. 3, 3A, and 3B will be more readily understood. The sequence identified in the flow chart of FIGS. 3, 3A, and 3B is continuously monitored. At any time, the operator may change the default settings by entering programmable parameters (block 80). The sequencer 34 receives an analog signal representing the process variable from sensing device 47 which is converted to a digital quantity (block 82). An initial test is made at decision block 84 to determine whether the process variable is greater than the preferred set-point. If the process variable is greater than the preferred set-point, the process variable is considered above, and if the process variable is less than the preferred set-point, the process variable is considered below.

When the process variable is above the preferred set-point, a series of steps are then made to determine whether the process variable is above and leaving or above and returning toward the preferred set-point (see connector 86 and FIG. 3A). There is a region slightly above or slightly below the preferred set-point known as the "deadband". In this region, the process variable may vary slightly from the preferred set-point without requiring a change in the firing rate, thus suppressing a tendency toward hunting. This is accomplished in block 110 by adding one-half of the deadband constant value to the preferred set-point. A test is then made at 112 to determine whether the process variable is greater than this new preferred set-point. If it is not, a further test is made to determine whether the process variable is returning or leaving the preferred set-point (block 120). If the process variable is greater than the new set-point a further test is made to determine whether the minimum time for the process variable response has elapsed (see block 114). If the time has not elapsed, it is then determined whether the process variable is returning or leaving the preferred set-point (block 120). If the minimum response time has elapsed, it is then determined whether the process variable movement for the minimum response time is greater than the preset minimum response required for the process variable movement (see block 116). If the process variable is less than this minimum response, it activates the adjustable nudge factor. Block 118 shows the firing rate being adjusted by this preprogrammed nudge factor. It is then determined whether the process variable is leaving or returning to the preferred set-point (block 120). Had the test at decision block 116 revealed that the process variable movement was greater than the minimum required response, a further test would then have been made to determine whether the process variable was leaving or returning toward the set-point (block 120).

If the old process variable is greater than the new process variable, the process variable is said to be returning toward the preferred set-point. If the old process variable is less than the new process variable, the process variable is said to be leaving the preferred set-point. If the process variable is returning toward the preferred set-point, the rate to readjust the firing rate is multiplied by the difference between the old process variable and the new process variable. This amount is then multiplied by the maximum decrease factor. The rate to readjust the firing rate is determined by taking the decrease return factor and dividing by the decrease span range (block 122). In block 124, it is then determined whether the resulting amount, X, added to the current firing rate is less than the maximum decrease factor ($P_{111}$). If it is, the resulting amount, X, is added to the current firing rate (block 126). If the resulting amount, X, added to the current firing rate is greater than the maximum decrease factor, the firing rate is adjusted to equal the maximum decrease factor (block 128). It is then determined whether the process variable has risen above the maximum process variable or has fallen below the threshold process variable (see connector 88 and block 94 in FIG. 3).

Had the test revealed in block 120 that the process variable was leaving away from the preferred set-point, the rate to readjust the firing rate would be multiplied by the difference between the new process variable and the old process variable, and further multiplied by the maximum decrease factor (block 130). The rate to readjust the firing rate is determined by taking the decrease leaving factor and dividing by the decrease span range. In block 132, it is then determined whether the resulting amount, X, subtracted from the current firing rate is less zero. If the resulting amount, X, subtracted from the current firing rate is less than zero, the firing rate is set equal to zero (block 134). If the resulting amount, X, subtracted from the current firing rate is greater than or equal to zero, the firing rate is reduced by the resulting amount, X (block 136). It is then determined whether the process variable is greater than the maximum process variable value or lower than the threshold minimum process variable value (see connector 88 and block 94 in FIG. 3).

Had the initial test at block 84 determined that the process variable was below the preferred set-point, a series of steps would then be executed to determine whether the process variable is below and leaving or below and returning toward the preferred set-point (see connector 90 and FIG. 3B). As earlier explained, there is a region slightly above or slightly below the preferred set-point known as the "deadband". In this region, the process variable may vary slightly from the preferred set-point without requiring a change in the firing rate. This deadband is created by executing the computations identified in block 140, i.e., subtracting one-half of the deadband constant value from the preferred set-point. A test is then made to determine whether the process variable is less than this new adjusted set-point (block 142). If it is not less, a further test is made to determine whether the process variable is returning or leaving the preferred set-point (block 150). If it is less, a further test is made to determine whether the minimum time for the process variable response has elapsed (see block 144). If the time has not elapsed, it is then determined whether the process variable is returning or leaving the preferred set-point (block 150). If the minimum response time has elapsed, it is then determined whether the process variable movement for the minimum response is greater than the preset minimum response required for the process variable (see block 146).

If the process variable movement is less than this minimum response, it activates the adjustable nudge factor. Block 148 shows the firing rate being adjusted by this nudge factor. It is then again determined whether the process variable is leaving or returning to the preferred set-point (block 150). Had the tested decision block 146 revealed that the process variable was greater than the minimum required response a test would then have been made to determine whether the process variable was leaving or returning toward the set-point (block 150).

If the old process variable is greater than the new process variable, it is said to be leaving the preferred set-point. If the old process variable is less than the new process variable, it is said to be returning toward the preferred set-point. If the process variable is returning toward the preferred set-point, the rate to readjust the firing rate is multiplied by the difference between the new process variable and the old process variable. This amount is then multiplied by the maximum increase factor. The rate to readjust the firing rate is determined by taking the increase return factor and dividing by the increase span range (block 152). In block 154, it is then determined whether the resulting amount, X, subtracted from the current firing rate is less than zero. If the resulting amount, X, subtracted from the current firing rate is less than zero, the firing rate is set equal to zero (block 156). If the resulting amount, X, subtracted from the current firing rate is greater than or equal to zero, the firing rate is reduced by the resulting amount, X (block 158). It is then determined whether the process variable is greater than the maximum process variable value or lower than the threshold minimum process variable value (see connector 92 and block 94 in FIG. 3).

Had the test revealed in block 150 that the process variable was leaving away from the preferred set-point, the rate to readjust the firing rate would be multiplied by the difference between the old process variable and the new process variable and further multiplied by the maximum increase factor (block 160). The rate to readjust the firing rate is determined by taking the increase leaving factor and dividing by the increase span range. In block 162, it is then determined whether the resulting amount, X, added to the current firing rate is less than the maximum increase factor ($P_{111}$). If it is, the resulting amount, X, is added to the current firing rate (block 164). If the resulting amount, X, added to the current firing rate is greater than the maximum increase factor, the firing rate is adjusted to equal the maximum increase factor (block 166). It is then determined whether the process variable has risen above the maximum process variable or has fallen below the threshold process variable (see connector 92 and block 94 in FIG. 3).

At block 94 in FIG. 3, it is determined whether the process variable is exceeding the maximum process variable value. If the current PV has exceeded the maximum process variable set-point, it is then determined whether the firing rate for the boiler is greater than the force low firing rate value (block 102). If the force low firing rate is less than the current firing rate, the boiler firing rate is reset to force low firing rate (block 104). If the force low firing rate is greater than the current firing rate, the firing rate remains the same and the signal is sent to the boiler system (block 106).

If the process variable is not greater than the maximum process variable value (block 94), another test is made to determine whether the process variable is less than the threshold minimum process variable value (block 96). If it is, a further test is made to determine whether the forced high firing rate is less than the current firing rate (block 98). If it is, the firing rate remains the same and a signal is sent to the boiler system. If the forced high firing rate is not less than the current firing rate, the firing rate is adjusted to equal the forced high firing rate (block 100), and this new firing rate is sent to the boiler system (block 106). After the signal is sent to the boiler system, the sequencer program will loop back to the start of the program and on the next pass through the program, will monitor the parameters anew, allowing the operator to adjust the parameters at any time. The sequencer receives a new process variable from the sensor and repeats the above algorithm.

It should also be appreciated by those skilled in the art that the firing rate sequencing afforded by the apparatus of the present invention can be used with a system incorporating more than one boiler. For example, in a two boiler arrangement, after the firing rate signal has been sent to the boiler system, the proper firing rate to be sent to the second boiler may be determined using the same process variable. The algorithm operates substantially the same as explained above except the parameters for the second boiler may be different from those assigned to the first boiler.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A boiler sequencer system comprising:

(a) at least one boiler, having a means for sensing the existing firing rate and providing a sense signal proportional thereto, a means for varying the firing rate of said boiler, and a means for sensing an output of said boiler and providing a sense signal proportional thereto;

(b) a microprocessor based controller having memory means for storing in relation to time a plurality of programmable parameter values for said boiler, including a firing rate, a maximum rate to increase or decrease the firing rate, a threshold minimum process variable value, a firing rate nudge factor, a maximum process variable value, a forced high firing rate value, a forced low firing rate value, a rate to readjust the firing rate, a preferred set-point value, and a means for entering said plurality of parameters into said memory means; and (c) a means including the microprocessor based controller for determining an output signal for adjusting the firing rate proportional to a rate of recovery of the process variable and for transmitting said output signal to said boiler.

2. A device as recited in claim 1 in which said means for determining an output signal for adjusting said firing rate further comprises means in said controller for automatically increasing the firing rate to a force high firing rate when the process variable is less than a predetermined minimum process variable value and for automatically decreasing the firing rate to a force low firing rate when the process variable exceeds a predetermined maximum process variable value.

3. A device as recited in claim 1 in which the plurality of parameter values further includes an increase return factor, a decrease return factor, and increase span range, a decrease span range, and a process variable minimum required response.

4. A microprocessor-based controller with a plurality of preset programmable parameters to control the firing rate of several boilers in parallel proportionate to the recovery rate of a process variable comprising:

(a) means for sensing said process variable and developing an analog electrical signal proportional thereto and connected to a microprocessor;

(b) said microprocessor having a ROM coupled to said microprocessor for storing a program of instructions, RAM coupled to said microprocessor for storing said plurality of preset parameters and various output values and operand developed during computations by said microprocessor, an input/output interface coupled to said microprocessor, a means for changing predetermined parameters coupled to said input/output interface, a display for viewing the input/output interface coupled to said input/output interface;

(c) means including said microprocessor for comparing said process variable with certain said preset parameters;

(d) means including said microprocessor-based controller for computing an output signal for varying said firing rate of said boiler in proportion to said recovery rate; and (e) means for transmitting said output signal to said boilers.

5. A device as recited in claim 4 in which said means for computing an output signal for varying said firing rate further comprises: means for automatically increasing the firing rate to a force high firing rate value when the process variable is less than a predetermined minimum process variable value and for automatically decreasing the firing rate to a force low firing rate value when the process variable exceeds a predetermined maximum process variable value.

6. A method of controlling the rate of increase or decrease in firing rate in a plurality of engaged boilers, in proportion to the rate of change in output, each of said boilers having a means for varying the firing rates thereof, and a means for sensing the existing firing rate and providing a sense signal proportional thereto, comprising the steps of:

(a) storing in the memory of a microprocessor-based controller a plurality of parameter values for each of said plurality of boilers, including a firing rate, a maximum rate to increase or decrease the firing rate, a threshold minimum process variable value, a firing rate nudge factor, maximum process variable value, a force high firing rate value, a force low firing rate value, a rate to readjust the firing rate, a preferred set-point value, and a means for entering said plurality of parameters into said memory;

(b) determining whether the process variable is above or below the preferred set-point;

(c) determining whether the process variable is approaching or leaving the preferred setpoint;

(d) iteratively adjusting the firing rate proportionate to the rate at which the process variable is approaching or leaving the preferred set-point from a value either above or below the preferred set-point; and (e) iteratively adjusting the firing rate in proportion to the rate of recovery in accordance with a fluctuating process variable.

7. The method of claim 6 further comprising the step of automatically increasing the firing rate to a force high firing rate when the process variable is less than a predetermined minimum process variable value or automatically decreasing the firing rate to a force low firing rate when the process variable exceeds the predetermined maximum process variable value.

8. The method of claim 6 in which the plurality of parameter values further includes an increase return factor, a decrease return factor, an increase span range, a decrease span range, and a process variable minimum required response.

9. The method of claim 8 and further comprising the step of adding a predetermined firing rate nudge factor when the rate of recovery of the process variable within a predetermined time is less than a predetermined minimum process variable response.

* * * * *